US012515296B2

(12) United States Patent
Zuniga et al.

(10) Patent No.: US 12,515,296 B2
(45) Date of Patent: Jan. 6, 2026

(54) POLISHING CARRIER HEAD WITH FLOATING EDGE CONTROL

(71) Applicant: Applied Materials, Inc., Santa Clara, CA (US)

(72) Inventors: Steven M. Zuniga, Soquel, CA (US); Andrew J. Nagengast, Sunnyvale, CA (US); Jay Gurusamy, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 165 days.

(21) Appl. No.: 17/684,284

(22) Filed: Mar. 1, 2022

(65) Prior Publication Data

US 2022/0281064 A1 Sep. 8, 2022

Related U.S. Application Data

(60) Provisional application No. 63/156,895, filed on Mar. 4, 2021.

(51) Int. Cl.
*B24B 37/30* (2012.01)

(52) U.S. Cl.
CPC ..... *B24B 37/30* (2013.01)

(58) Field of Classification Search
CPC ..... B24B 37/30; B24B 37/27; B24B 37/32; B24B 37/10; B24B 37/005; B24B 37/04; B24B 37/042; B24B 49/08; B24B 49/16; B24B 7/228
See application file for complete search history.

(56) References Cited

U.S. PATENT DOCUMENTS 6,241,593 B1 * 6/2001 Chen ..... B24B 37/30 451/288
6,244,942 B1 6/2001 Zuniga
6,358,121 B1 * 3/2002 Zuniga ..... B24B 37/30 451/388
6,361,419 B1 3/2002 Zuniga et al.
(Continued)

FOREIGN PATENT DOCUMENTS

CN 101474771 7/2012
CN 207656469 U * 7/2018 ..... B24B 37/102
(Continued)

OTHER PUBLICATIONS

Translation of KR 20150129196 A (Year: 2015).*
(Continued)

*Primary Examiner* — David S Posigian
*Assistant Examiner* — Steven Huang
(74) *Attorney, Agent, or Firm* — Fish & Richardson P.C.

(57) ABSTRACT

A carrier head for holding a substrate in a polishing system includes a housing, an annular body that is vertically movable relative to the housing by an actuator, a first annular membrane secured to extending below the annular body to form at least one lower pressurizable chamber between the first annular membrane and the annular body, and at least one pressure supply line connected to the at least one lower pressurizable chamber. The annular body includes an upper portion and at least one lower post projecting downward from the upper portion, with the at least one lower post located inside the at least one lower pressurizable chamber.

18 Claims, 11 Drawing Sheets

(56) References Cited

U.S. PATENT DOCUMENTS

| | | | | |
|---|---|---|---|---|
| 6,431,968 | B1 | 8/2002 | Chen et al. | |
| 6,494,774 | B1 | 12/2002 | Zuniga et al. | |
| 6,659,850 | B2 | 12/2003 | Korovin et al. | |
| 6,857,945 | B1 | 2/2005 | Chen et al. | |
| 6,896,584 | B2 | 5/2005 | Perlov et al. | |
| 7,040,971 | B2 | 5/2006 | Zuniga et al. | |
| 8,100,743 | B2 * | 1/2012 | Nabeya | B24B 37/32 451/286 |
| 2001/0041526 | A1 | 11/2001 | Perlov et al. | |
| 2001/0044268 | A1 | 11/2001 | Shendon | |
| 2002/0039879 | A1 | 4/2002 | Zuniga et al. | |
| 2002/0151251 | A1 | 10/2002 | Zuniga | |
| 2003/0008604 | A1 * | 1/2003 | Boo | B24B 37/30 451/388 |
| 2004/0067719 | A1 * | 4/2004 | Zuniga | B24B 37/32 451/8 |
| 2006/0116056 | A1 * | 6/2006 | Boo | B24B 37/32 451/41 |
| 2006/0199479 | A1 * | 9/2006 | Togawa | B24B 37/30 451/59 |
| 2007/0082589 | A1 * | 4/2007 | Zuniga | B24B 37/30 451/288 |
| 2008/0318499 | A1 | 12/2008 | Yasuda et al. | |
| 2012/0034849 | A1 | 2/2012 | Chen et al. | |
| 2013/0065495 | A1 * | 3/2013 | Gajendra | B24B 37/30 451/364 |
| 2014/0150974 | A1 * | 6/2014 | Oh | H01L 21/67092 156/345.23 |
| 2014/0242886 | A1 | 8/2014 | Woo et al. | |
| 2014/0273776 | A1 * | 9/2014 | Leighton | B24B 41/061 451/490 |
| 2016/0039066 | A1 | 2/2016 | Schauer | |
| 2020/0147751 | A1 | 5/2020 | Son et al. | |

FOREIGN PATENT DOCUMENTS

| | | | | | |
|---|---|---|---|---|---|
| CN | 108604543 | A | | 9/2018 | |
| CN | 209812012 | U | | 12/2019 | |
| CN | 218110400 | U | | 12/2022 | |
| JP | 2006-159392 | | | 6/2006 | |
| JP | 2018176414 | A | * | 11/2018 | B24B 37/00 |
| KR | 10-2001-0039710 | A | | 5/2001 | |
| KR | 10-2014-0067325 | | | 6/2014 | |
| KR | 10-2014-0125289 | A | | 10/2014 | |
| KR | 20140125289 | A | * | 10/2014 | H01L 21/304 |
| KR | 20150060238 | A | * | 6/2015 | |
| KR | 20150129196 | A | * | 11/2015 | |
| TW | 434111 | | | 5/2001 | |
| TW | I432288 | | | 4/2014 | |
| TW | 202045307 | | | 12/2020 | |
| TW | 202108296 | A | | 3/2021 | |
| WO | WO 2002/004172 | | | 1/2002 | |
| WO | WO-2017171262 | A1 | * | 10/2017 | H01L 21/67309 |

OTHER PUBLICATIONS

Translation of KR 20150060238 A (Year: 2015).*
Translation of JP 2018176414 A (Year: 2018).*
Translation of CN 207656469 U (Year: 2018).*
Translation of WO 2017171262 A1 (Year: 2017).*
Translation of KR 20140125289 A (Year: 2014).*
International Search Report and Written Opinion in International Appln No. PCT/US2022/018344, dated Jun. 8, 2022, 9 pages.
Office Action in Taiwanese Appln. No. 111107969, dated Feb. 9, 2023, 16 pages (with English search report).
Office Action in Chinese Appln. No. 202210208134.7, dated Sep. 15, 2024, 18 pages (with English translation).
Zhou et al., "Primary Study of the Carrier of CMP," Nov. 15, 2008, Micronanoelectronic Technology, 11:668-671 (English abstract only).
Office Action in Japanese Appln. No. 2023-553543, dated Sep. 17, 2024, 10 pages (with English translation).
Decision to Grant Patent in Japanese Appln. No. 2023-553543, dated Jan. 28, 2025, 5 pages (with English translation).
Office Action in Chinese Appln. No. 202210208134.7, dated Mar. 15, 2025, 18 pages (with English translation).

* cited by examiner

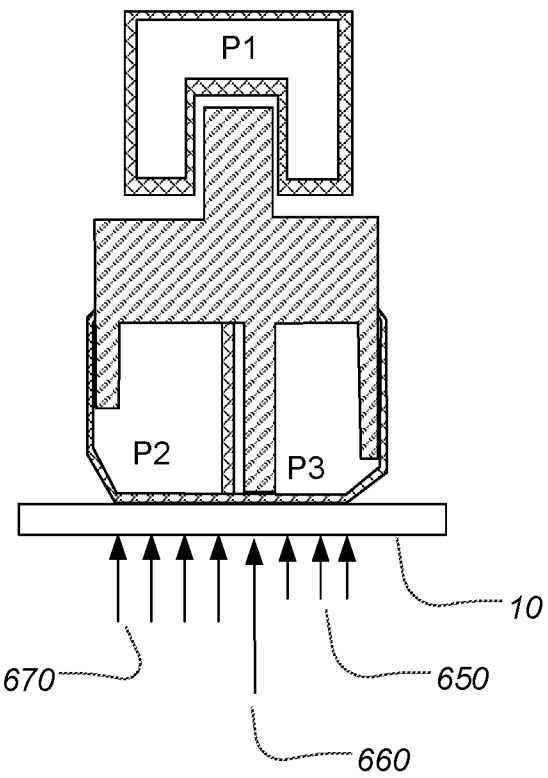
FIG. 6A
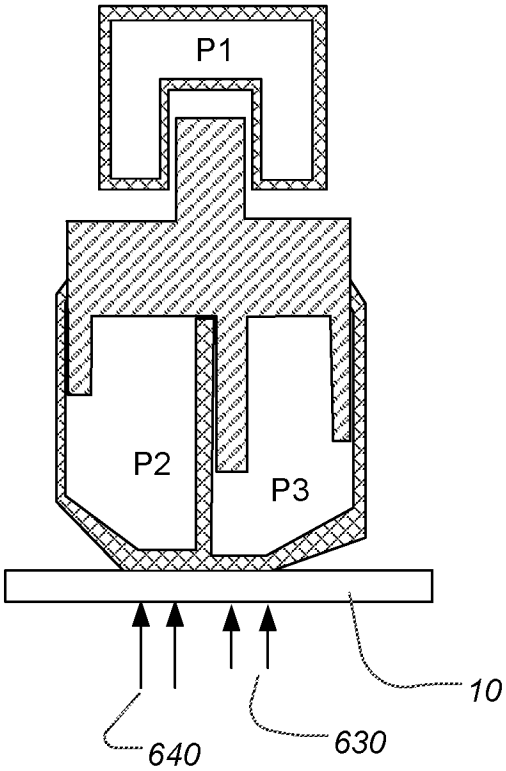
FIG. 6B
FIG. 6C

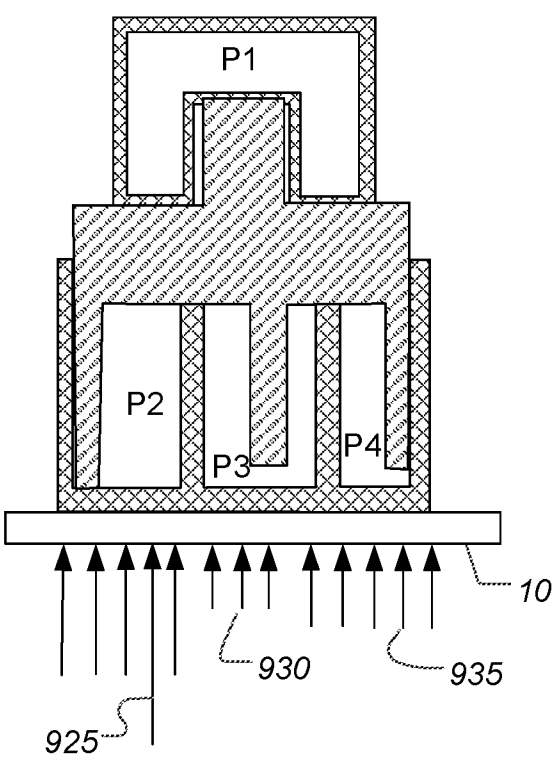
FIG. 9A
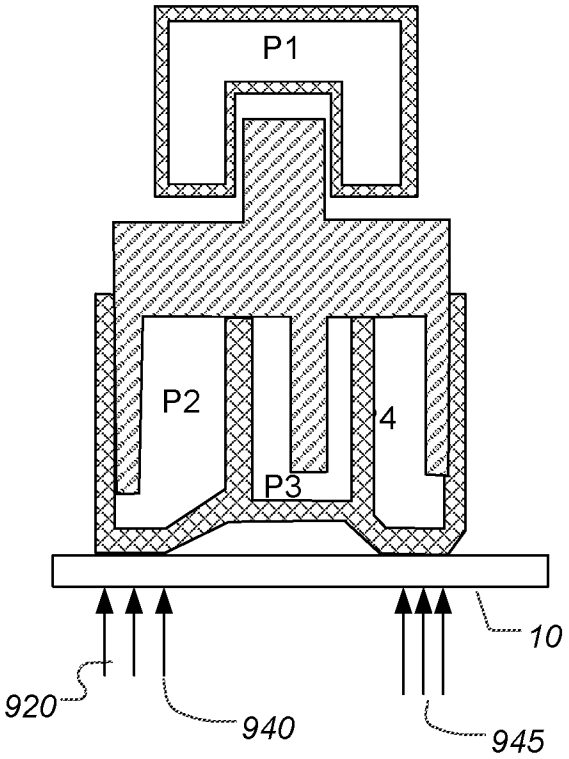
FIG. 9B
FIG. 9C

POLISHING CARRIER HEAD WITH FLOATING EDGE CONTROL

CROSS-REFERENCE TO RELATED APPLICATIONS

This claims the benefit of priority to U.S. Application No. 63/156,895, filed on Mar. 4, 2021, the contents of which are hereby incorporated by reference.

TECHNICAL FIELD

The present disclosure relates generally to chemical mechanical polishing, and more particularly to control of the polishing rate near the substrate edge.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface and planarizing the filler layer. For certain applications, the filler layer is planarized until the top surface of a patterned layer is exposed or a desired thickness remains over the underlying layer. In addition, planarization may be used to planarize the substrate surface, e.g., of a dielectric layer, for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. In some polishing machines, the carrier head includes a membrane that forms multiple independently pressurizable radially concentric chambers, with the pressure in each chamber controlling the polishing rate in each corresponding region on the substrate. A polishing liquid, such as slurry with abrasive particles, is supplied to the surface of the polishing pad.

SUMMARY

In one aspect, a carrier head for holding a substrate in a polishing system includes a housing, an annular body that is vertically movable relative to the housing by an actuator, a first annular membrane secured to extending below the annular body to form at least one lower pressurizable chamber between the first annular membrane and the annular body, and at least one pressure supply line connected to the at least one lower pressurizable chamber. The annular body includes an upper portion and at least one lower post projecting downward from the upper portion, with the at least one lower post located inside the at least one lower pressurizable chamber.

Certain implementations can include, but are not limited to, one or more of the following possible advantages.

The described techniques can improve overall uniformity for a substrate undergoing polishing. The system can adjust a load distribution at the edge of a substrate by applying different distributed pressures over different regions and one or more focused forces at different locations on the edge region of the substrate. The system can adjust one or more pressures in one or more pressurizable chambers formed by the first annular membrane to change the loading area, and the amount of distributed pressure over the substrate.

The system can also include an annular body with one or more downward-extruding lower posts. The system can deform the second annular membrane by using different pressure supplies to displace one or more lower posts substantially downward to contact and apply one or more respective focused forces onto one or more corresponding focused regions of the substrate. The locations of the focused regions where respective focused forces are applied can also be adjusted by changing the shape, location, and the number of the lower posts attached to the annular body.

The system, therefore, is easy to adapt to a variety of edge polishing profiles and can adjust a combination of forces applied on the annular edge region of a substrate to customize the polishing rate in the region. In some implementations, the system can increase the effective pressure on at least a portion of the region, and decrease the effective pressure on other portions of the region to adjust the polishing rate of particular regions in the substrate. Thus, the polishing process of the annular edge region of the layer on the substrate can be controlled dynamically with a higher definition.

More specifically, the magnitude of the effective pressure and the effective area of the edge region are determined based on loading combinations (i.e., distributed and concentrated forces) from each chamber. Greater flexibility is provided for applying a particular pressure distribution to the outer portion of the wafer.

The details of one or more embodiments of the invention are set forth in the accompanying drawings and the description below. Other features, objects, and advantages are apparent from the description and drawings, and from the claims.

DESCRIPTION OF DRAWINGS

FIGS. 6A-6C illustrate schematic cross-sectional views of the pressure controller assembly of FIG. 3 in different states.

FIGS. 9A-9C illustrate schematic cross-sectional views of the pressure controller assembly of FIG. 4C in different states.

Like reference numbers and designations in the various drawings indicate like elements.

DETAILED DESCRIPTION

Figure 1:
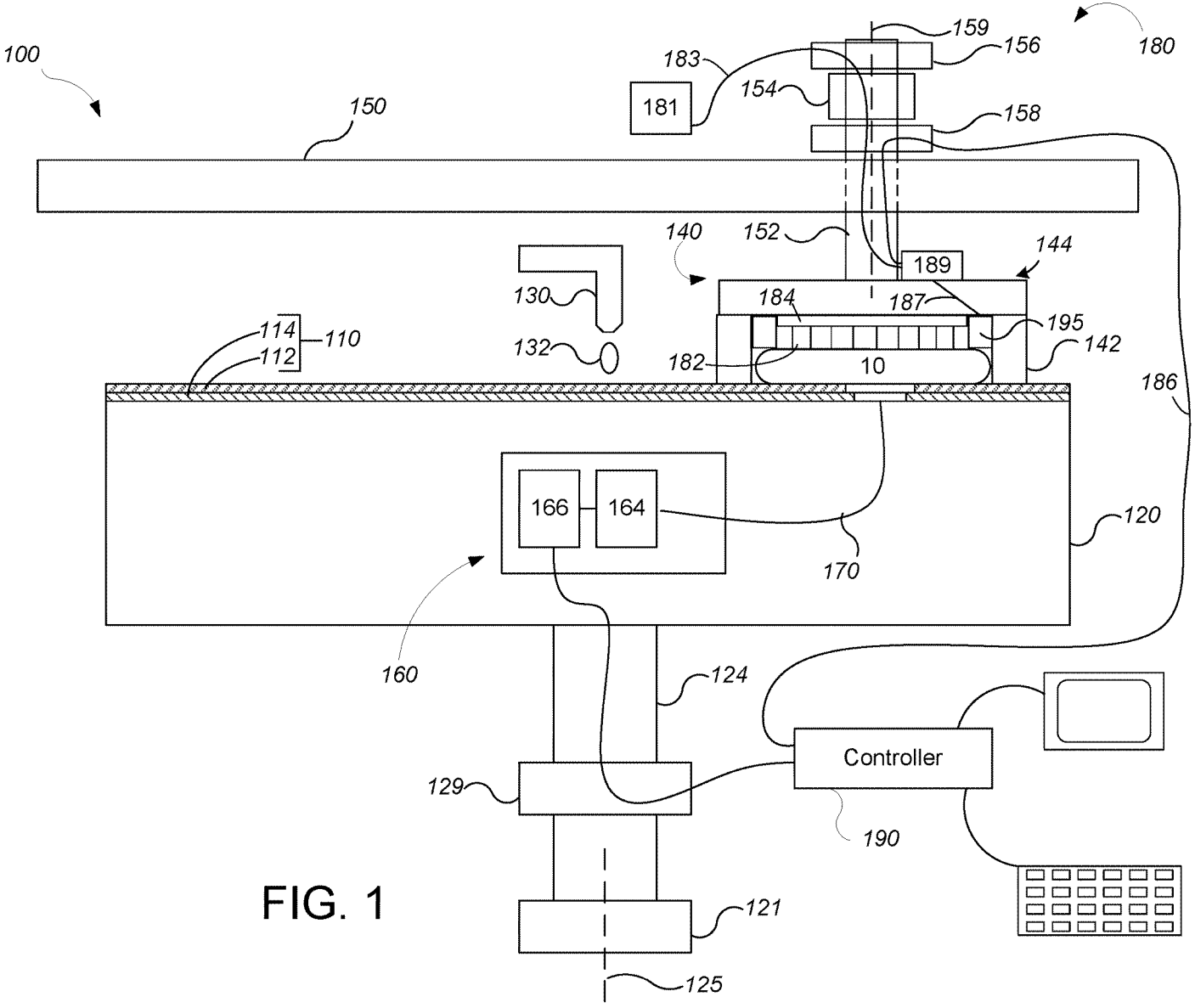
FIG. 1 illustrates a schematic cross-sectional view of an example of a polishing apparatus.

In an idealized process, due to the rotation of the carrier head and the platen, the polishing rate on a substrate would be radially uniform from the axis of rotation of the substrate. In practice, however, the polishing process can result in radial variations in the polishing rate. Besides, a substrate to be polished can have initial radial non-uniformity, i.e., a top layer with an initial thickness that varies along the radial direction from the axis of rotation of the substrate.

Polishing rate variations between different regions of a substrate, or non-uniform initial profile of a substrate, or both, can lead to the different regions of the substrate reaching their target thickness at different times.

More specifically, the different regions of the substrate may not reach the desired thickness if polishing of the regions is halted simultaneously, resulting in a non-uniform thickness profile of the substrate. In particular, an annular region that is about 10 mm wide and starts about 4-6 mm from the edge of the substrate, also referred to as a "checkmark region," can substantially suffer from non-uniformity. In particular, the checkmark region has a slower polishing rate, or is under-polished, compared to a center region of the substrate after a polishing process.

A technique to correct the polishing rate in the checkmark region is to modify the pressure in an outermost chamber of the carrier head. This changes the pressure on the edge region of the substrate, e.g., the outer 15-20 mm of the substrate. However, increasing the pressure in the outermost chamber can result in severe overpolishing of the outer 1-2 mm at the substrate.

However, a carrier head that adopts the techniques described herein can provide superior control of pressure distribution and reduce non-uniformities near the substrate edge. The carrier head can include a pressure control assembly including a first annular membrane forming one or more pressurizable chambers, and an annular body having one or more downward extruding lower posts. Optionally, the annular body can include a second annular membrane forming another pressurizable annular chamber. In practice, the system can adjust the pressure with each chamber formed by the annular membranes by a controller to control both the size of the contact area and pressure on the contact area between the assembly and the substrate. The chambers can also be deformed due to different pressure in the other annular chamber. In particular, the other chamber can deform to displace downward one or more lower posts to contact and apply a force onto a focused region of the substrate. The assembly can apply distributed forces within a controllable contact area in the substrate, or focused forces applied at controllable focused regions in the substrate, or both accordingly.

Therefore, the system can apply different combinations of distributed forces and focused forces in the edge region of a substrate in a controllable fashion with high definition. Given that, the system can achieve effective control of polishing edge region in a substrate, permitting reduction of non-uniformity in edge region in a substrate.

FIG. 1 illustrates an example of a polishing apparatus 100. The polishing apparatus 100 includes a rotatable disk-shaped platen 120 on which a polishing pad 110 is situated. The platen 120 is operable to rotate about an axis 125. For example, a motor 121 can turn a drive shaft 124 to rotate the platen 120. The polishing pad 110 can be detachably secured to the platen 120, for example, by an adhesive layer. The polishing pad 110 can be a two-layer polishing pad with an outer polishing layer 112 and a softer backing layer 114.

The polishing apparatus 100 can include a dispensing port 130 to deliver a polishing liquid 132, such as an abrasive slurry, onto the polishing pad 110. The polishing apparatus can also include a polishing pad conditioner to abrade the polishing pad 110 to maintain the polishing pad 110 in a consistent abrasive state.

The polishing apparatus 100 includes a carrier head 140 operable to hold a substrate 10 against the polishing pad 110. The carrier head 140 can be configured to control a polishing parameter independently, for example, pressure, for each of multiple zones on the substrate 10.

The carrier head 140 is suspended from a support structure 150, e.g., a carousel, and is connected by a drive shaft 152 to a carrier head rotation motor 154 so that the carrier head can rotate about an axis 159. Optionally the carrier head 140 can oscillate laterally, e.g., on sliders on the carousel 150; or by rotational oscillation of the carousel itself. In operation, the platen is rotated about its central axis 125, and each carrier head is rotated about its central axis 159 and translated laterally across the top surface of the polishing pad.

The carrier head 140 can include a housing 144 that can be connected to a drive shaft 152, a support plate 184 that extends above a flexible central membrane 182, an annular pressure control assembly 195 that surrounds the flexible central membrane 182, and a retaining ring 142 that surrounds the annular pressure control assembly 195 to retain the substrate 10 below the flexible central membrane 182.

The lower surface of flexible central membrane 182 provides a mounting surface for the substrate 10. The flexible central membrane 182 can include one or more flaps secured to the support plate 184 to form one or more pressurizable chambers. These chambers are connected to one or more pressure supplies 181 through respective pressure supply lines 183 for applying different pressure onto the inner area (e.g., regions at least 6 mm away from the substrate edge) of a substrate when polishing, so that the system can adjust respective polishing rates on respective regions in the substrate.

The pressure control assembly 195 can also form one or more pressurizable chambers. Each of the pressurizable chambers is connected to a different pressure supply 181 through a respective pressure supply line 183. The detailed structural description of the pressure control assembly 195 will be discussed below.

The polishing apparatus can further include a valve assembly 189, e.g., equipment that controllably connects various chambers to various pressure supplies. For example, the valve assembly can be mounted on the top of the housing 144 of the carrier head 140, as shown in FIG. 1. For another example, the valve assembly can be mounted on top of the support plate 184 inside the carrier head 140. Alternatively, as above discussed, each chamber can also be directly connected to the pressure supplies 181 through pressure supply lines 183.

The polishing apparatus can include a controller 190 to control the pressure within each chamber formed within the pressure control assembly 195. For example, for cases where a pressure valve assembly 189 is in use, each chamber of the pressure control assembly can be connected to a dedicated valve in the valve assembly 189 through a respective pressure output line 187. Each pressure output line 187 can be provided by passages through the housing 144, or flexible tubing, or both. Although only one pressure output line 187 is shown in FIG. 1 for ease of illustration, there would be a separate pressure output line 187 for each chamber within the pressure control assembly 195.

The valve assembly 189 can receive a plurality of pressure inputs through a plurality of pressure supply lines 183 from a plurality of pressure sources 181. Again, although only one pressure supply line 183 and one pressure source 181 are shown in FIG. 1 for ease of illustrations, there can be more pressure supply lines, e.g., eight to sixteen pressure supply lines, and there can be more pressure sources, e.g., eight to sixteen pressure sources. The pressure supply lines 183 can be provided by passages through the drive shaft 152 and/or housing 144 and/or flexible tubing, and a rotary union 214 extending through the housing 144. Pressure can be routed from the stationary components, e.g., the pressure source 183, through a rotary pneumatic union 156, to the carrier head 140.

Figure 2:
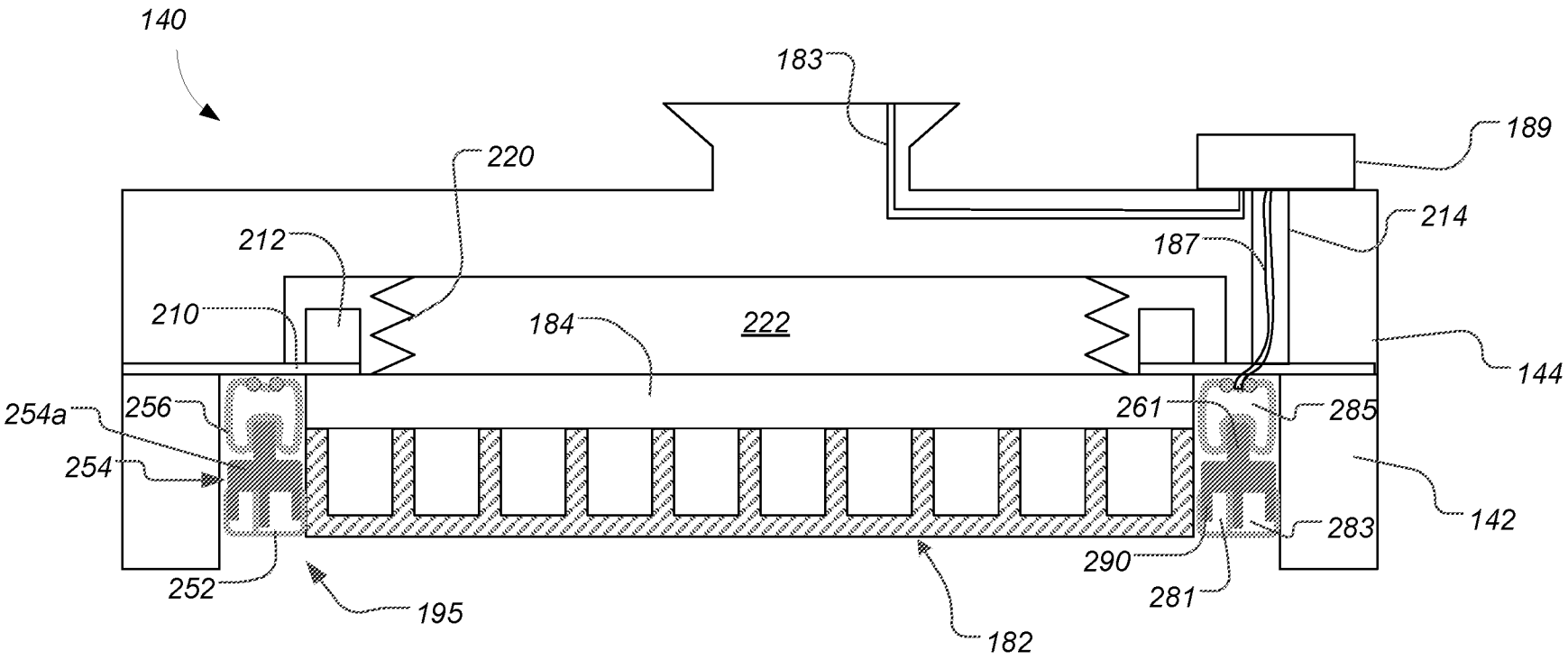
FIG. 2 illustrates a schematic cross-sectional view of a carrier head.

FIG. 2 illustrates a schematic cross-sectional view of a carrier head 140. The carrier head 140 includes a support plate 184 and the central membrane 182 having a plurality of annular or angular flaps 204. The flaps can be secure to the support plate 184 by clamps. The central membrane 182 can be made of a flexible and somewhat elastic material, e.g., a rubber, such as silicone rubber or neoprene. The membrane can be formed from thermoset materials using a mold such that the molded membrane forms as a single body.

In some implementations, the support plate 184 is coupled to the housing 144 by a flexure 210, e.g., an annular membrane, formed of a plastic or rubber, e.g., silicone rubber or neoprene. An inner edge of the flexure 210 can be clamped between the top of the support plate 184 and a clamp ring 212, and an outer edge of the flexure can be clamped between the retaining ring 142 and the housing 144.

A region between the support plate 184 and the housing 144 can be sealed by an expandable seal 220, e.g., by a flexible membrane or bellows, to form a pressurizable upper chamber 222 between the housing 144 and support plate 184.

Alternatively, the flexure 210 could provide the seal. Pressure in the upper chamber 222 can thus control the vertical position of the support plate 184 or downforce of the support plate 184 on the central membrane 182. In some implementations, pressure in the upper chamber 222 can control the pressure of the retaining ring 142 on the polishing pad. In some implementations, the central membrane 182 is clamped directly to the housing 144; a separate support plate 184 is omitted and its function is provided by the housing 144.

The carrier head 140 further includes an annular pressure control assembly 195 positioned between the retaining ring 142 and the central membrane 182. The assembly 195 includes an actuator 256 that is located below the housing 144, e.g., below the flexure 210. In some implementations, the top of the actuator 256 can be constrained by the bottom surface of the flexure 210 so that the top of the actuator 256 cannot move vertically.

The actuator 256 can have a pressurizable bladder 285 connected to a respective pressure output line 187, or directly with a pressure supply chain 183 (not illustrated). The valve assembly 189 or the pressure supply 181 can provide or change pressure for the pressurizable bladder 285. The bladder 285 is made of deformable materials such as a plastic or rubber, e.g., silicone rubber or neoprene, so that the bladder 285 can deform due to a change of pressure within the bladder. Alternatively, the actuator 256 could be provided by a motor, e.g., a linear actuator, or piezoelectric device.

The pressure control assembly 195 also includes an annular body 254 that is vertically movable relative to the housing 144 by the actuator 256. The annular body 254 includes an upper portion 254*a* and at least one lower post 290 projecting downward from the upper portion 254*a*. The annular body is made of hard plastic, e.g., polyether ether ketone (PEEK) or polyphenylene sulfide (PPS) with Young's modulus around 400-500 ksi, or a metal, e.g., aluminum or stainless steel. The upper portion 254*a* of the annular body is connected to the actuator 256. For example, an upper annular post 261 of the annular body 254 can extend into a recess formed by the bottom surface of the pressurizable bladder 285.

To move the annular body 254, the control 190 can increase the pressure inside the bladder 256 to expand the bladder, therefore applying a substantial downward pressure onto the upper annular post 261 to displace the annular body 254 downwardly relative to the housing 144.

The pressure control assembly 195 further includes a first annular membrane 252 secured to the upper portion of the annular body 254 to form at least one lower pressurizable chamber (e.g., 281 and/or 283) between the first annular membrane 252 and the annular body 254 with the at least one lower post 290 located inside the at least one lower pressurizable chamber. The first annular membrane 252 can be secured to the upper portion 254*a* of the annular body 254 by clamps, or adhesive materials, or by overmolding the elastomer of the membrane. The first annular membrane 252 can be made of any proper elastic or plastic material with Yong's modulus around 100 psi, for example, rubber, e.g., silicon rubber or neoprene.

In operation, the various chambers 222, 285, etc., can be pressurized such that the bottom surface of the first annular membrane 252 is at substantially the same height as that of the central membrane 182. In conjunction, the central membrane 182 and the annular membrane 252 cover the entire top surface of a substrate 10 substantially during polishing. The membranes 182, 252 can also adjust the pressure applied in respective regions of the substrate to correct the local polishing rate. In some implementations, there can be a gap between the central membrane 182 and the annular membrane 252 when not polishing a substrate, and the gap is closed up upon proper pressure within each chamber formed by the membranes 182 and 252 when polishing the substrate.

Each of the one or more presumable chambers 281, 283 formed by the first annular membrane 252 can be connected to the valve assembly 189 through respective pressure output lines 187 or directly connected to a respective pressure supply through a respective pressure supply line 183 (not illustrated).

Because the bladder 285 and each of the chambers 281, 283 are connected to a respective pressure supply, the region of the substrate to which pressure is applied by the assembly 195 can be controlled according to the overall combination of pressures in the chambers. For example, the contact area between the first annular membrane 252 and the substrate, or whether the at least one lower post 290 in a respective chamber can contact and apply a force on the top surface of a membrane, or both, depend on pressure conditions within the bladder and each chamber. The pressure conditions can be, for example, a ratio of pressure between the bladder and the chambers formed by the first annular membrane, or a ratio of pressure in each chamber formed by the first annular membrane. The detail of different configurations due to different pressure conditions will be described further below.

The pressurizable chambers formed by the first annular membrane can include two, three, or more chambers. The details of alternative structures will be described below.

Furthermore, the number of lower posts can be three, five, or more, and the shape of lower posts can be rectangular, cylindrical, or any other proper shape that permits a force being applied in a substantially focused region. One or more of the lower posts can further include a flange portion pointing in a substantially horizontal direction, e.g., the axial direction of the flange portion is in a horizontal direction. The details of the alternative structures of the lower posts will be described further below.

Figure 3:
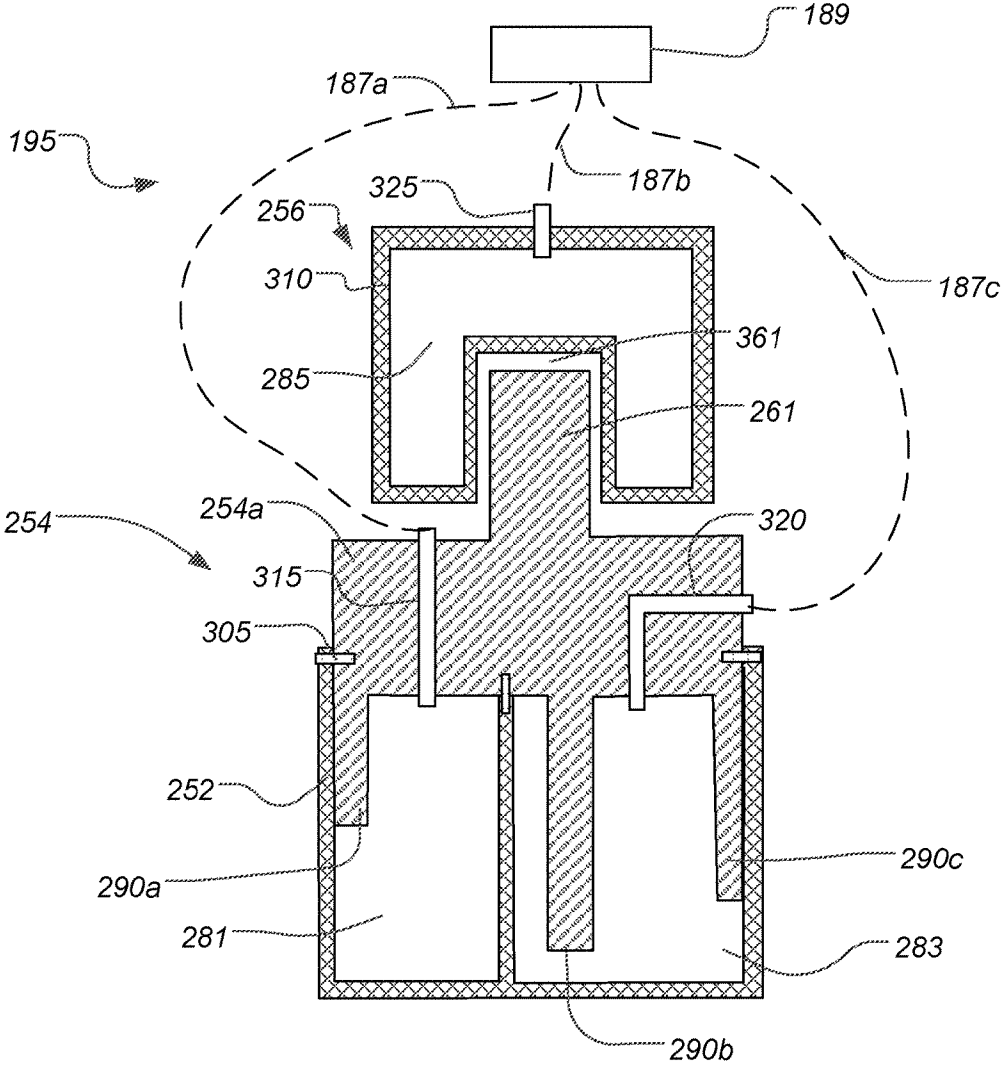
FIG. 3 illustrates a schematic cross-sectional view of a pressure control assembly for controlling pressure on edge regions of a substrate.

FIG. 3 a schematic cross-sectional view of a pressure control assembly 195 for controlling pressure on edge regions of a substrate.

The pressure control assembly 195 includes an annular body 254 that is configured to be positioned over the edge region of a substrate 10. The annular body 254 can include one or more lower posts 290*a,* 290*b,* and 290*c* and an upper post 261.

The pressure control assembly 195 also includes the actuator 256 secured above the annular body 254. The actuator 256 includes a membrane or shell 310 that forms up a pressurizable bladder 285. A passage or pipe 325 through a portion of the membrane 310 is configured to connect to an external pressure supply/output line 187*b*. Through the pressure supply line 187*b* and the passage 325, the pressurizable bladder 285 can be supplied with a specific amount of pressure. To connect with the annular body 254, the actuator 256 can include a recess 361 in the bottom surface of the membrane 310. The recess 361 is configured to engage and be secured to the upper post 261 of the annular body, e.g., a pressure fit or adhesive attachment, to name just a few examples.

The pressure control assembly 195 further includes a first annular membrane 252 secured to the upper portion 254*a* of the annular body 254 to form up one or more pressurizable chambers 281, 283 with the lower portion of the annular body. The first annular membrane 252 can be secured to the annular body 254 through any suitable connection, for example, by clamp rings 305 or adhesive. Each chamber, 281 and 283, of the chambers formed by the first annular membrane 252 can enclose one or more lower posts 290*a,* 290*b,* and 290*c* extending downward from the annular body 254.

During an initial state, e.g., before the polishing operation, the lower posts are not in contact with the inner surface of the membrane 252. However, and at least one of the lower posts is configured to be displaced to contact and apply a force in a focused region of a corresponding portion of an inner surface of the membrane 252. During polishing this results in transmission of a focused force in a narrow annular zone on the back surface of the substrate. At least one of the lower posts 290 can be displaced by, for example, one or more pressure change in one or more chambers 281, 283, or a pressure change in the bladder 285, or both.

Each chamber 281 and 283 includes a passage, or tube, or both, for connecting with a corresponding pressure supply/output line 187 for applying a respective pressure in each chamber. The passage can be located through any appropriate portion of the membrane 252, or the annular body 254. For example, the passage 315 is formed starting from the top surface of the annular body 254 substantially downward until the lower surface of the lower post 290*a*. As another example, the passage 320 is formed starting from the side surface of the annular body 254 and extending horizontally for a first portion, and then extending substantially downward for a second portion until the bottom surface of the annular body 254. Optionally, each passage can include a pipe or tube to connect with a respective pressure supply line.

For situations where the polishing apparatus 100 includes the valve assembly 189, each pressure supply line 187*a,* 187*b,* and 187*c* is connected with a respective valve in the valve assembly 189 to apply a particular pressure into a respective chamber 281, 283, and 285. The controller 190 can, through the valve assembly 190, control a pressure change inside each chamber so that the final configuration of the assembly 195 is changed accordingly.

The above-described materials, shapes, and configurations for each component of the assembly 195 are purely exemplary for the ease of illustration, and any other proper materials, designs, and configurations can also be adopted.

Figure 4C:
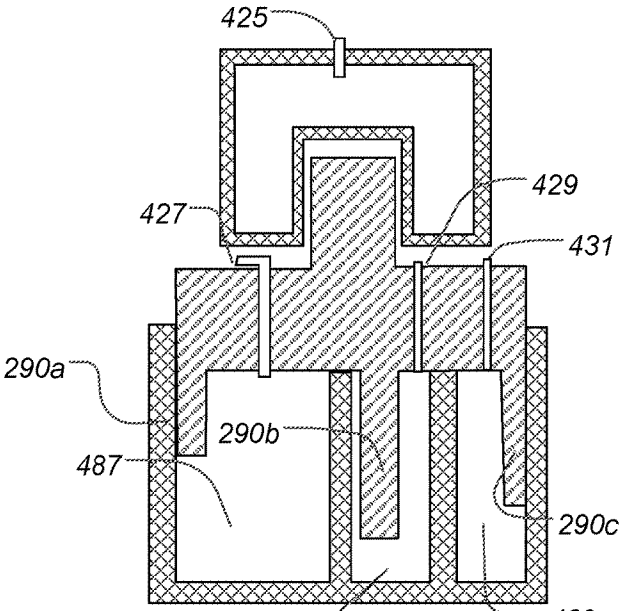
FIGS. 4A-4C each illustrates another example of the pressure control assembly.
Figure 4B:
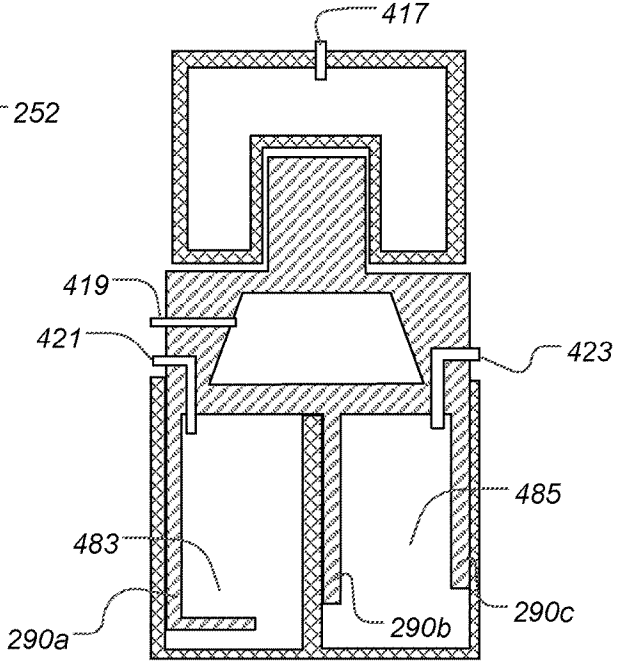
Figure 4A:
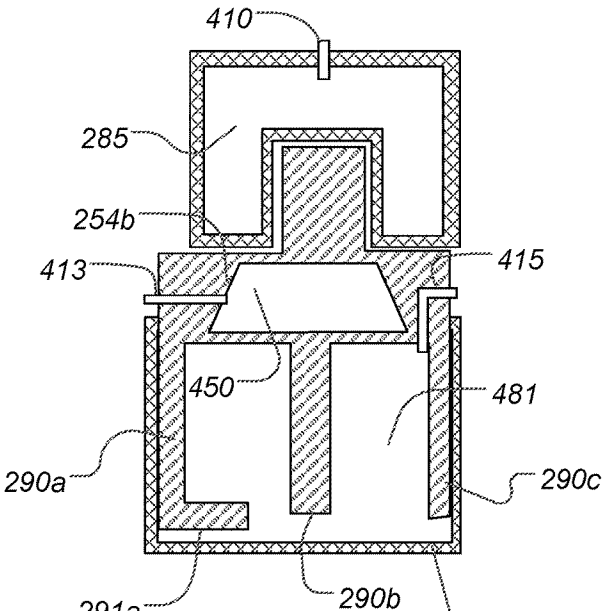

FIGS. 4A-4C each illustrates another example of the pressure control assembly 195. In some implementations, referring to the configuration presented in FIG. 4A, the annular body 254 of the pressure control assembly 195 can include a second annular membrane 254*b* secured to the annular body 254 to define an upper annular chamber 450. The at least one lower post 290 is secured to the bottom surface of the second annular membrane. The second annular membrane 254*b* is configured to deform downward in response to the pressure increase in the upper annular chamber 450 to downwardly displace the at least one lower post, e.g., 290*b,* to contact and apply a force on a top surface of the first annular membrane 252.

In some embodiments, the first annular membrane 252 secured to the annular body 254 to define a single lower chamber 481. The chambers 285, 450, and 481 are each independently pressurizable, and each connected to a pressure supply line through a respective passage or tube. For example, the upper annular chamber 450 can be connected with a pressure supply line using a pipe 413 inside a passage through a side of the annular body 254. As another example, and chamber 481 is connected with a pressure supply line through passage 415 located on another side of the annular body 254.

Furthermore, one of the lower posts, e.g., the radially outermost post 290*a,* includes a flange 291*a* that extends radially outward into the chamber 481 (radially outward from the center of the carrier head). The flange 291*a* can have any suitable annular profile. For example, the bottom surface of the flange 291*a* can be planar and horizontal, or be planar but canted relative to the horizontal, or be non-planar. When the post 290*a* having a flange 291*a* contacts and applies a focused force onto the substrate, the force applied should be smaller than that of a post without a flange.

In some implementations, referring to the configuration presented in FIG. 4B, the first annular membrane 252 can form two chambers 483 and 485, as similarly described for FIG. 3. The first chamber 483 includes one lower post 290*a* with an inward extending flange 291*a,* and the second chamber 485 includes two lower posts 290*b,* 290*c* without flanges. Each of the chambers, 285, 450, 483, and 485, is connected to a different pressure supply line through a respective passage or pipe.

Each lower post can have a respective length, width, and the depth. Alternatively, each lower post can be substantially identical in shape. The bottom surface of the one or more lower posts can be configured to be coplanar in an initial state. Alternatively, the bottom surfaces of the lower posts can locate in different horizontal positions. In particular, in implementations that do not include the upper annular chamber 450, two of the posts can have a co-planar bottom surface so that pressure is applied in two separate annular regions by the two posts. On the other hand, in implementations that include the upper annular chamber 450, the post that is attached to the second annular membrane, e.g., the middle post 290*b,* can be slightly shorter or have a bottom surface that is recessed slightly when the upper annular chamber 450 is not pressurized.

In some implementations, referring to the configuration presented in FIG. 4C, the first annular membrane 252 can form three chambers 487, 488, and 489, in which each chamber has a respective lower post. Similarly, each of the chambers, 285, 487, 488, and 489, is connected to a different pressure supply line.

Figure 5B:
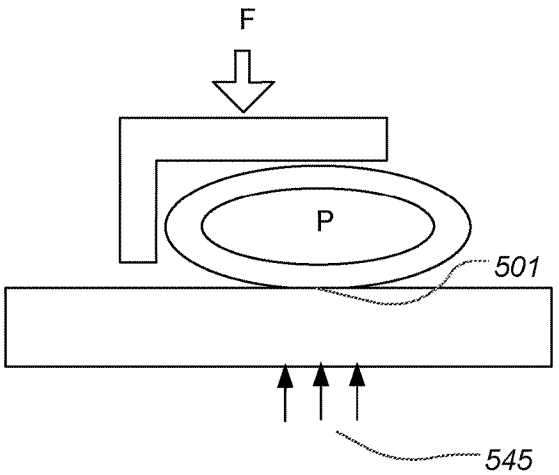
FIGS. 5A-5C schematically illustrate how the pressure control assembly applies effective forces on a region of a substrate.
Figure 5A:
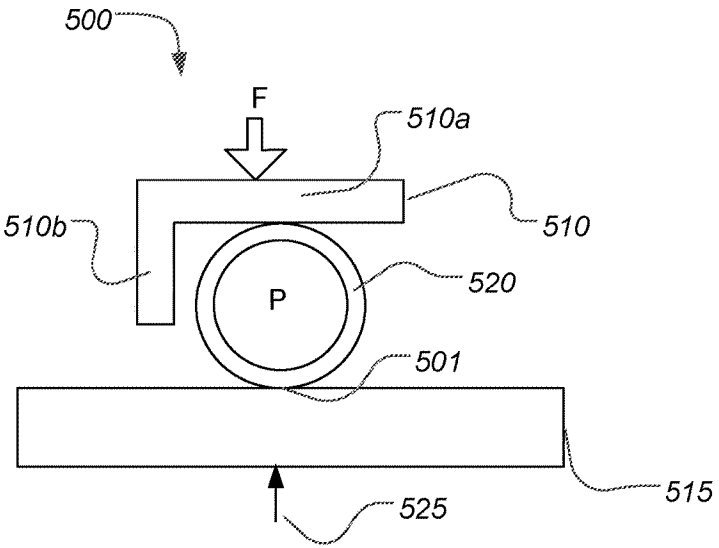
Figure 5C:
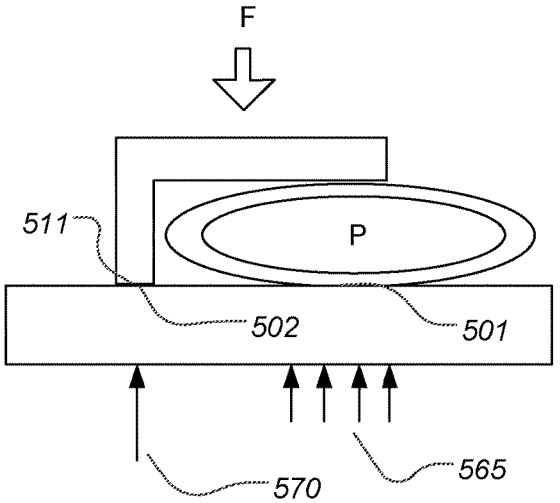

FIGS. 5A-5C schematically illustrate how the pressure control assembly 195 applies effective forces on a region of a substrate. As a preliminary matter, the assembly 195 takes similar approaches as the system 500, by adjusting a magnitude of a force applied, to apply different magnitudes and types of forces in different regions of a substrate 515. According to Newton's law, the forces presented in the figures described below are reactional forces, each having the same magnitude but opposite direction of the corresponding force applied onto the substrate. For simplicity, these reactional forces are also referred to as forces applied onto the substrate.

Referring to FIG. 5A, the schematic system 500 includes a spherical or annular bladder 520 formed by a spherical or annular membrane 520 with an internal pressure P, a clamp-shape part 510 placed on top of the bladder, and a substrate 515 upon which the bladder 520 is initially placed. The clamp-shape part 510 includes a horizontal portion 510*a* and a vertical portion 510*b*. The horizontal portion of the part 510 contacts with an upper portion of the bladder in a manner that the initial contact region 501 between the substrate 515 and bladder 520 can be a focused region that is either a substantially point or circular, depending on whether or not the clamp-shape part 510 is circular. The vertical portion 510*b* of the part 510 is initially not in contact with the substrate 515 or the bladder 520, but is configured to displace downward under a force applied on the horizontal portion of the part 510. The bladder 520 is also deformable under both inertial pressure P and external forces.

Initially, a downward force F, or a force substantially along with the gravity, is applied onto the horizontal portion 510*a* of the part 510. Within an area of the contact region 501 between the bladder 520 and the substrate 515, a certain pressure 525 is applied on the substrate due to the force F. The magnitude of the pressure 525 depends on the magnitude of the downward force and area of the contact region 501 between the bladder 520 and the substrate 515. The pressure 525 or the like is referred to as distributed force or loads in the description below.

Referring to FIG. 5B, as the magnitude of the downward force F increases, the bladder 520 deforms into an elliptical cross-sectional profile, and the part 510 and its vertical portion 510*b* displaces downward closer to the substrate 515. The pressure 545, or the distributed force, applied onto the substrate through the bladder can increase as the increase of the downward force F. Alternatively or in addition, the contact area 501 between the bladder 520 and the substrate 515 can increase. The amount of change in the contact area between the bladder and the substrate depends at least in part on the mechanical properties of the material that the bladder is made of, the magnitude of internal pressure P, and the magnitude of the downward force F.

Referring to FIG. 5C, the magnitude of the downward force F further increases such that the bladder 520 further deforms, and the vertical portion 510*b* of the part 510 is further displaced downward to eventually contact and apply a force directly to the substrate 515 within a second contact area 502. If the profile of the bottom surface 511 of the vertical portion 510*b* is narrow, e.g., no more than 5 mm wide, e.g., no more than 3 mm wide, e.g., no more than 2 mm wide, the applied force can be regarded as a concentrated force, or a focused force, or, more generally, a focused pressure 570.

In some implementations, the different internal pressure P of the chamber can be varied to change the contact area between the bladder and the substrate while maintaining the same external load F. Therefore, the system 500 can have more different magnitudes and types of forces to be applied on different regions in the substrate using different combinations of downward force F and internal pressure P, of which the idea is similarly adopted in the below-described techniques.

The different states for each example configuration of the assembly 195 presented in FIGS. 3, and 4A-4C will be described in the following specifications in connection with FIGS. 6A-6C, 7A-7F, 8A-8F, and 9A-9C. The details of each state in connection with the polishing control of different edge regions will be discussed below.

FIGS. 6A-6C illustrates a schematic cross-sectional view of the pressure controller assembly 195 of FIG. 3 in different states.

Referring back to FIG. 3, the first example pressure controller assembly 195 includes three chambers, i.e., the bladder formed by the actuator 256, and two chambers 281 and 283 formed by the first annular membrane 252, each chamber is connected to a respective pressure supply P1, P2, and P3. The pressures P1, P2, and P3 are changeable either by changeable pressure supply tanks or switching between different pressure supplies through the valve assembly 189 under control by a controller 190. The pressure P1 should balance with the other pressure P2 and P3 in an equilibration state.

Referring to FIG. 6A, the assembly 195 is in a first state, in which none of the lower posts are displaced and in contact with the first membrane. Thus in the first state, the assembly 195 applies only distributed pressure 610 and 620 on the substrate 10, in which the magnitude of pressure 610 and 620 equals the pressure P3 and P2 within the corresponding chamber. The first state is also referred to as the wide contact patch.

Referring to FIG. 6B, the assembly 195 is now in a second state. To change from the first state to the second state, the assembly 195 increases the pressure of P2 and P3 so that the contact area between the first annular membrane and the substrate decreases in an equilibrium state. In equilibrium, the increased pressure P2 and P3 multiplying the corresponding decreased contact area equals the P1 multiplying the contact area of the upper post. In some implementations, the assembly 195 can increase P1, P2, and P3 together to reach the second state, as long as the ratio of (P2+P3) to P1 increases. In the second state, the assembly 195 can apply an increased amount of pressure 630 and 640 onto a smaller region in the substrate, increasing the polishing rate in the smaller region. The magnitudes of pressure 630 and 640 are based on P3 and P2 in each chamber, respectively. The second state is also referred to as the narrow contact patch.

Referring to FIG. 6C, the assembly 195 is now in a third state. To change from the first state to the third state, the assembly 195 increases the pressure P1 to displace downward one or more lower posts to contact and apply a force onto the first membrane. Because the contact area between the lower posts and the first membrane is small, the assembly 195 can eventually apply a relatively concentrated force onto the substrate. For example, the central post of the annular body contacts the first membrane and then applies a concentrated force 660 onto the substrate. The assembly can alternatively increase pressure P1, P2, and P3 together, as long as the ratio of (P2+P3) to P1 decreases and the P1 is large enough compared to P2 and P3 for displacing one of the posts to contact with the first membrane. The other forces applied on the substrate are distributed forces 650 and 670, each depending on the internal pressure P3 and P2 within each chamber. In the third state, the assembly 195 can apply both distributed loads and a concentrated force on the edge region. More specifically, the assembly 195 can control (e.g., increase) a polishing rate of a central region of the substrate edge in a focused fashion by the concentrated force 660. The third state is also referred to as center focused wide contact patch.

FIGS. 7A-7F illustrate schematic cross-sectional views of the pressure controller assembly 195 of FIG. 4A in different states.

Referring back to FIG. 4A, the second example pressure controller assembly 195 includes three chambers, i.e., the bladder formed by the actuator 256, the single chamber 481 formed by the first membrane, and the chamber 450 formed by the second annular membrane (e.g., the annular body 254). Each chamber is connected to a respective pressure supply P1, P2, and P5, and the pressures P1, P2, and P5 are interchangeable to allow the assembly 195 to reach different states.

Figure 7A:
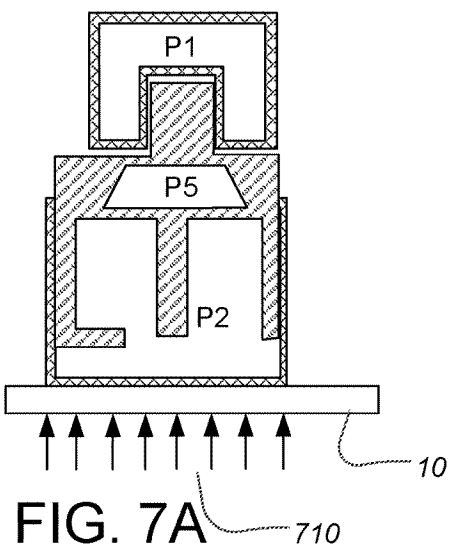
FIGS. 7A-7F illustrate schematic cross-sectional views of the pressure controller assembly of FIG. 4A in different states.

Referring to FIG. 7A, the assembly 195 is in a first state, in which none of the lower posts are displaced and in contact with the first membrane. Thus in the first state, the assembly 195 applies only a uniform distributed pressure 710 on the substrate 10, in which the magnitude of pressure 710 equals the pressure P2 within the chamber 481. The first state is also referred to as the wide contact patch.

Figure 7B:
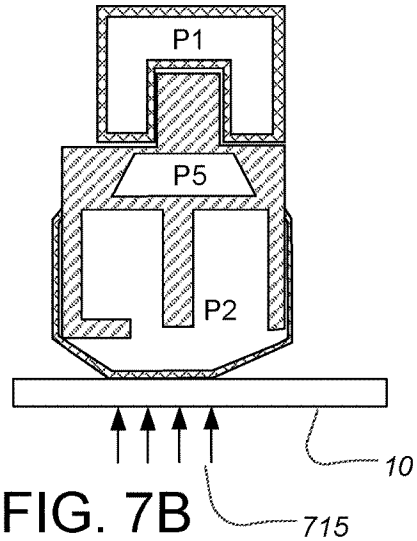

Referring to FIG. 7B, the assembly 195 is in a second state. In the second state, none of the lower posts are in contact with the first membrane, but the assembly applies a uniform distributed load 715 onto a smaller region of the substrate 10 (as compared to the first state). To change from the first state to the second state, the assembly 195 can decrease the ratio of P1 to P2 and keep P5 smaller than P2. The second state is also referred to as a narrow contact patch for controlling a polishing rate of a smaller edge region when polishing.

Figure 7C:
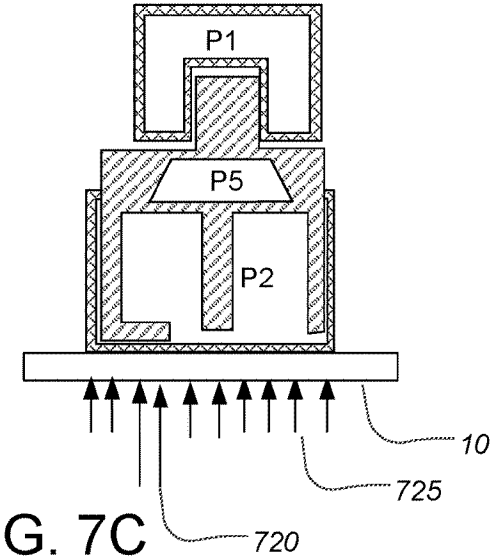

Referring to FIG. 7C, the assembly 195 is in a third state. In the third state, the outermost lower post 290*a* is displaced downward and eventually contacts and applies a concentrated force 720 on the first membrane. Therefore, the assembly 195 applies both a uniform distributed load 725 and the concentrated force 720 onto the substrate 10. To change from first state into the third state, the assembly 195 increases the ratio of pressure P1 to P2 and keeps the pressure P5 smaller than the pressure P2. The third state is also referred to as an outer focused plus wide contact patch for applying higher pressure on the outer edge region while still applying pressure across a wide area.

Figure 7D:
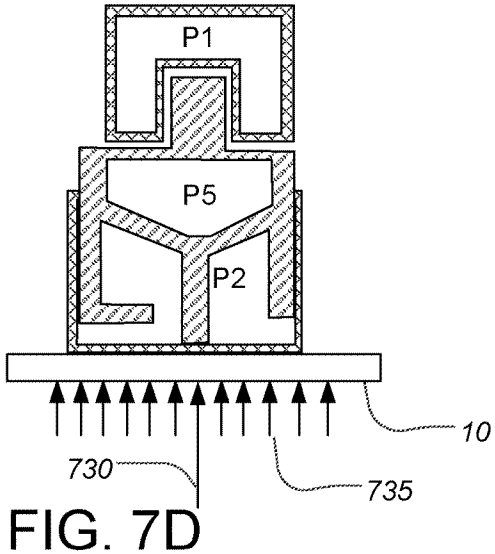

Referring to FIG. 7D, the assembly 195 is in a fourth state. The center lower post 290*b* is displaced downward and eventually contacts and applies a concentrated force 730 on the first membrane in the fourth state. Therefore, the assembly 195 applies both a uniform distributed load 735 and the concentrated force 730 onto the substrate 10. To change from the first state into the fourths state, the assembly 195 increases the ratio of pressure P5 to P2. The fourth state is also referred to as a center-focused plus wide contact patch for applying a higher pressure on the central region while still applying pressure across a wide area.

Figure 7E:
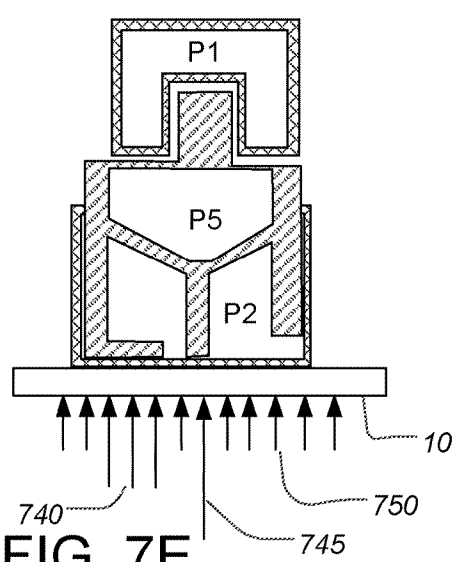

Referring to FIG. 7E, the assembly 195 is in a fifth state. In the fifth state, both the outermost and center lower posts 290*a*, 290*b* are displaced downward to eventually contact and apply concentrated forces 740 and 745 on the first membrane. Therefore, the assembly 195 applies a uniform distributed load 750 in the edge region, a concentrated force 740 in the outer edge region, and another concentrated force 745 in the central edge region of the substrate 10. To change from the first state into this state, the assembly 195 increases the ratio of pressure P1 to pressures P2, or P5, or P2+P5, and increases the ratio of pressure P5 to P2. The fifth state is also referred to as an outer and center-focused wide contact patch for applying more concentrated pressure on both the outer and central edge regions.

Figure 7F:
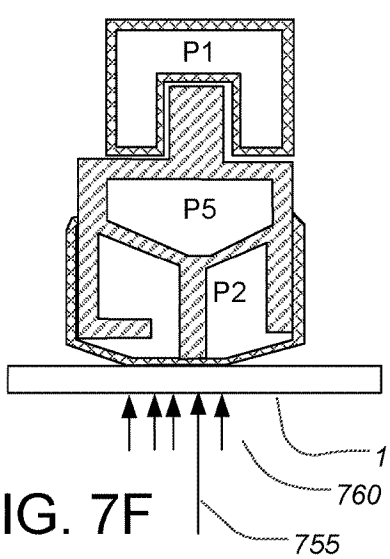

Referring to FIG. 7F, the assembly 195 is in a sixth state. Only the center lower post 290*b* is displaced downward, contacting and applying concentrated force 755 on the first membrane. Therefore, the assembly 195 applies a uniform distributed load 760 in the edge region, and a concentrated force 755 in the central edge region of the substrate 10. To change into this state, the assembly 195 decreases the ratio of pressure P1 to both pressures P2 and P5, and increases the ratio of pressure P5 to P2. The sixth state is also referred to as a center-focused plus narrow contact patch for applying higher pressure on the central edge region but with a narrower overall control region (compared to FIG. 7D).

FIGS. 8A-8F illustrate schematic cross-sectional views of the pressure controller assembly 195 of FIG. 4B in different states.

Referring back to FIG. 4B, the third example pressure controller assembly 195 includes four chambers, i.e., the bladder formed by the actuator 256, the chambers 483 and 485 formed by the first membrane, and the chamber 450 formed by the second annular membrane 254*b* (or the annular body 254). Each chamber is connected to a respective pressure supply P1, P2, P3, and P5, and the pressures P1, P2, P3, and P5 are interchangeable to permit the assembly 195 to reach different states.

Figure 8C:
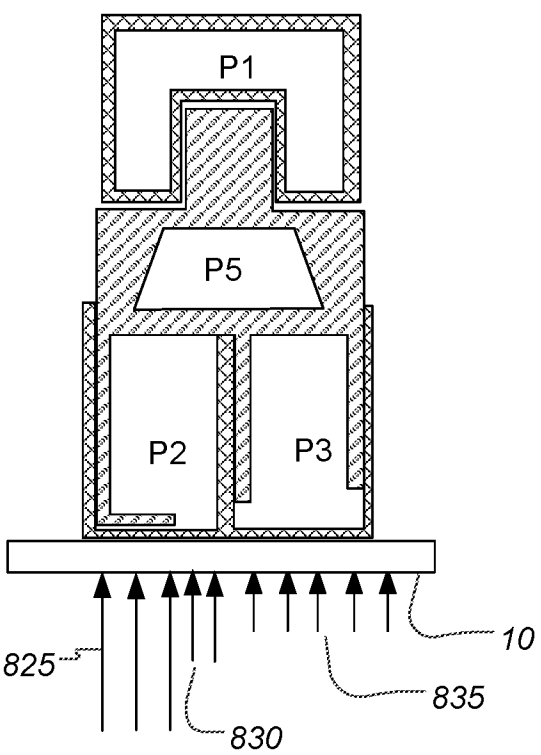
FIGS. 8A-8F illustrate schematic cross-sectional views of the pressure controller assembly of FIG. 4B in different states.
Figure 8B:
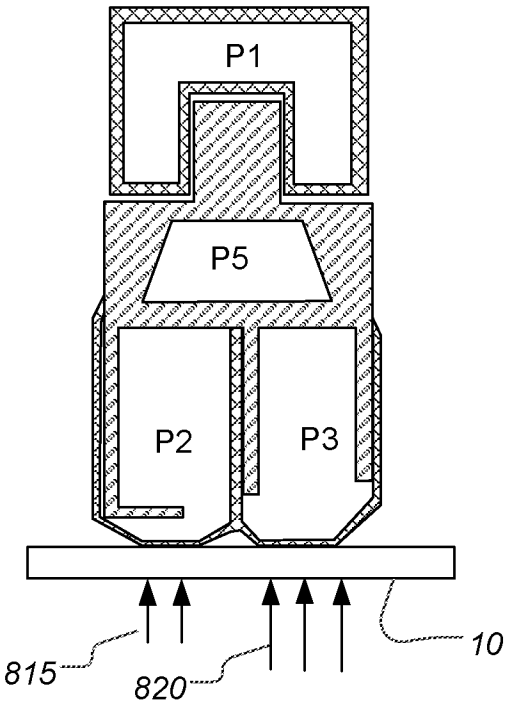
Figure 8A:
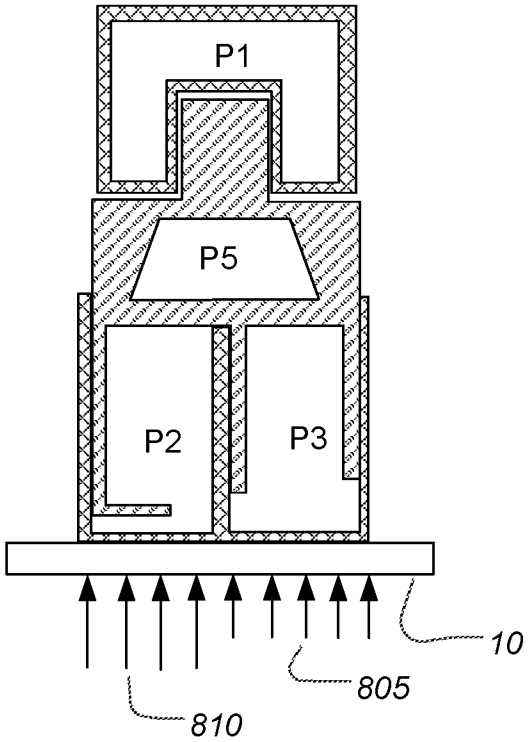

Referring to FIG. 8A, the assembly 195 is in a first state, in which none of the lower posts are displaced and in contact with the first membrane. Thus in the first state, the assembly 195 applies only distributed pressures 805 and 810 in the outer and inner edge region of the substrate 10. The magnitude of each pressure 805 and 810 equals the corresponding pressure P3 and P2. The first state is also referred to as the wide contact patch.

Referring to FIG. 8B, the assembly 195 is in a second state. In the second state, none of the lower posts are in contact with the first membrane. Therefore the assembly applies distributed loads 815 and 820 onto a smaller inner and outer region of the substrate 10. To change from the first state to the second state, the assembly 195 can increase the ratio of P2+P3 to P1 and keep the P5 smaller than P2+P3. The second state is also referred to as a narrow contact patch for controlling a polishing rate of a smaller edge region when polishing.

Referring to FIG. 8C, the assembly 195 is in a third state. In the third state, the outermost lower post 290*a* is displaced downward to eventually contact and apply a concentrated force 825 on the first membrane. Therefore, the assembly 195 applies uniform distributed loads 830, 835 in the outer and inner edge region, and concentrated force 825 onto the substrate 10. To change from the first state into this state, the assembly 195 increases the ratio of pressure P1 to P2, or P3, or P2+P3, and keeps the pressure P5 smaller than the pressure P2. The third state is also referred to as an outer focused plus wide contact patch for applying higher pressure on the outer edge region while still applying pressure across a wide area.

Figure 8F:
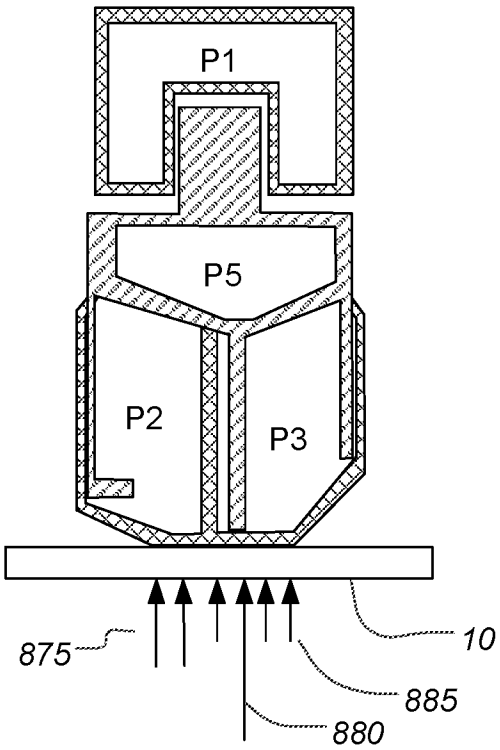
Figure 8E:
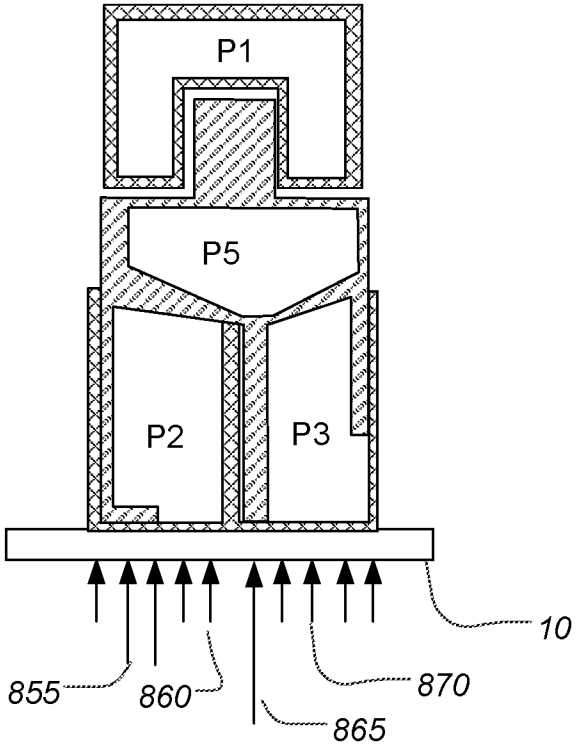
Figure 8D:
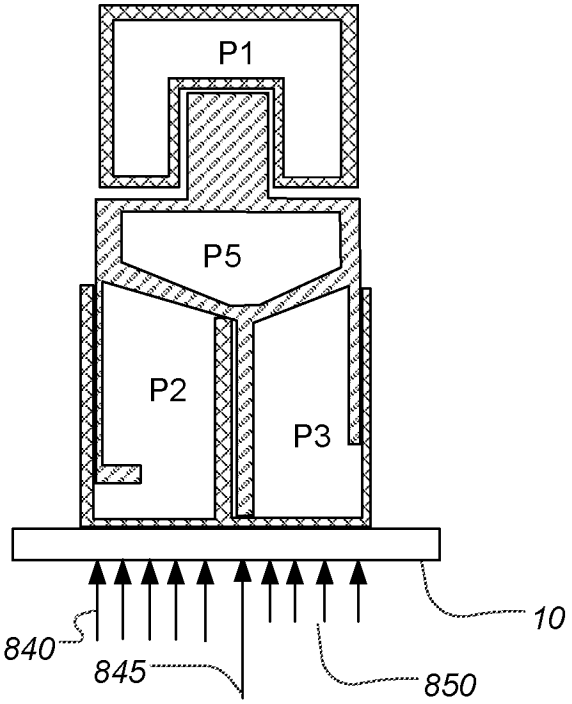

Referring to FIG. 8D, the assembly 195 is in a fourth state. The center lower post 290*b* is displaced downward to eventually contact and apply a concentrated force 845 on the first membrane in the fourth state. Therefore, the assembly 195 applies uniform distributed loads 840, 850 in the outer and inner edge region, and the concentrated force 845 onto the substrate 10. To change from the first state into this state, the assembly 195 increases the ratio of pressure P5 to P2, or P3 or P2+P3. The fourth state is also referred to as a center-focused plus wide contact patch for applying a higher pressure on the central region while still applying pressure across a wide area.

Referring to FIG. 8E, the assembly 195 is in a fifth state. In the fifth state, both the outermost and center lower posts 290*a*, 290*b* are displaced downward, contacting and applying concentrated forces 855 and 865 on the first membrane. Therefore, the assembly 195 applies uniform distributed loads 860, 870 in the outer and inner edge region, a concentrated force 855 in the outer edge region, and another concentrated force 865 in the central edge region of the substrate 10. To change from the first state into this state, the assembly 195 increases the ratio of pressure P1 to both pressure P2 and P3, and increases the ratio of pressure P5 to P2, or P3, or both P2+P3. The fifth state is also referred to as an outer and center-focused wide contact patch for applying more concentrated pressure on both the outer and central edge regions.

Referring to FIG. 8F, the assembly 195 is in a sixth state. Only the center lower post 290*b* is displaced downward to contact and apply concentrated force 880 on the first membrane in the sixth state. Therefore, the assembly 195 applies uniform distributed loads 875 and 885 in the outer and inner edge region, and the concentrated force 880 in the central edge region of the substrate 10. To change from the first state into this state, the assembly 195 decreases the ratio of pressure P1 to both pressure P2 and P3, and increases the ratio of pressure P5 to P2, or P3, or P2+P3. The sixth state is also referred to as a center-focused plus narrow contact patch for applying higher pressure on the central edge region but with a narrower overall control region (compared to FIG. 8D).

FIGS. 9A-9C illustrate schematic cross-sectional views of the pressure controller assembly 195 of FIG. 4C in different states.

Referring back to FIG. 4C, the fourth example pressure controller assembly 195 includes four chambers, i.e., the bladder formed by the actuator 256, and the chambers 487, 488, and 489 formed by the first membrane. Optionally, the assembly 195 can include another chamber formed by the second membrane 254*b* of the annular body 254 (not illustrated). Each chamber is connected to a respective pressure supply P1, P2, P3, and P4, and the pressures P1, P2, P3, and P4 are interchangeable to permit the assembly 195 reaching different states.

Referring to FIG. 9A, the assembly 195 is in a first state, in which none of the lower posts are displaced and in contact with the first membrane. Thus in the first state, the assembly 195 applies only distributed pressures 905, 910, and 915 in the three edge regions of the substrate 10. The magnitude of each pressure 905, 910, and 915 equals the corresponding pressure P4, P3, and P2. The first state is also referred to as the wide contact patch.

Referring to FIG. 9B, the assembly 195 is in a second state. In the second state, none of the lower posts are in contact with the first membrane, and the center chamber 488 is not in contact with the substrate 10. Therefore the assembly 195 applies distributed loads 940 and 945 onto two regions (i.e., inner and outer regions) of the substrate 10 with a smaller area. To change from the first state to the second state, the assembly 195 can decrease the ratio of pressure P1 to P2, or P4, or P2+P4. Optionally, the assembly 195 can also decrease the ratio of pressure P3 to P1, or P2, or P4, or any combination of P1, P2, and P4. The second state is also referred to as a narrow contact patch for controlling a polishing rate of a smaller edge region when polishing.

Referring to FIG. 9C, the assembly 195 is in a third state. In the third state, the outermost lower post is displaced downward, contacts, and applies a concentrated force 925 on the first membrane. Therefore, the assembly 195 applies uniform distributed loads 920, 930, and 935 in the outer, central, and inner edge regions, and the concentrated force 925 on the outer region in the substrate 10. To change from the first state into this state, the assembly 195 increases the ratio of pressure P1 to P2, and optionally increases the ratio of pressure P1 to P3 or P4. The third state is also referred to as an outer focused wide contact patch for applying more concentrated pressure on the outer edge region.

Figure 10:
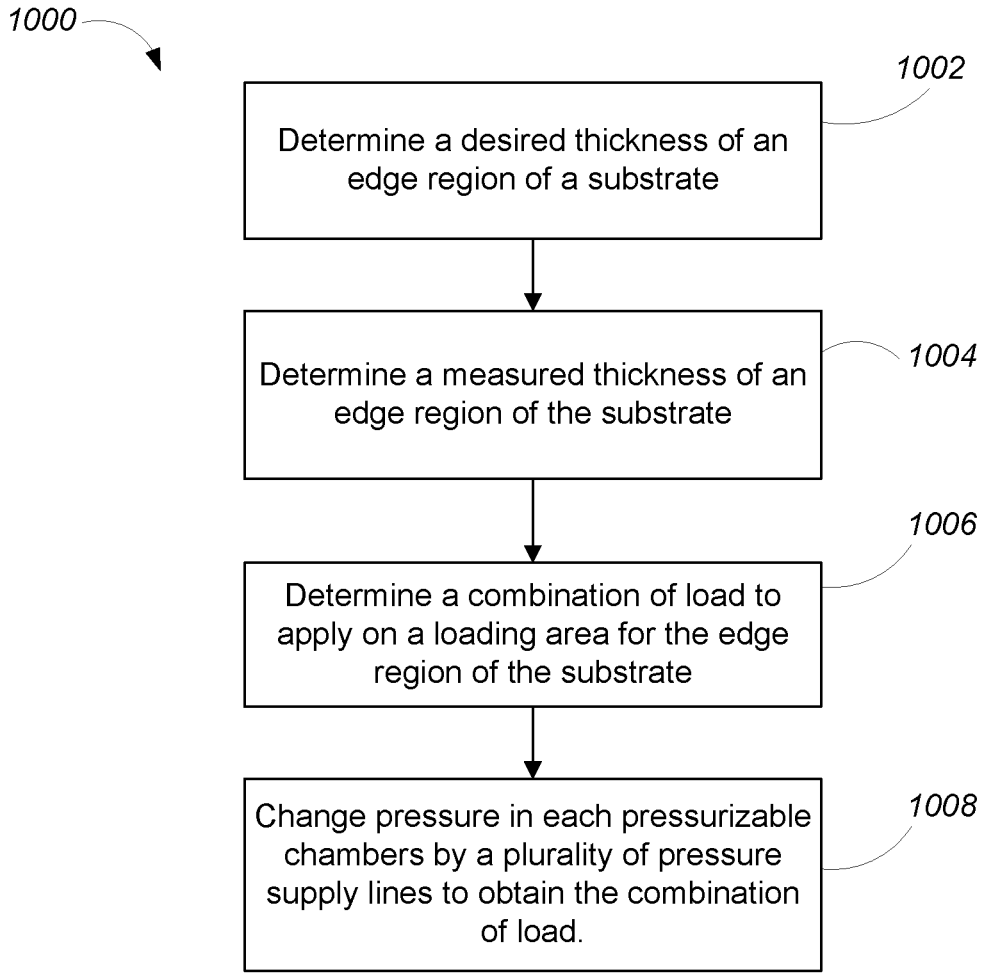
FIG. 10 is a flow diagram showing an example edge profile control process using a pressure controller assembly during polishing.

FIG. 10 is a flow diagram showing an example edge profile control process 1000 using a pressure controller assembly during polishing. The process 1000 can be executed by one or more computers located in one or more places. Alternatively, the process 1000 can be stored as instructions in the one or more computers. Once executed, the instructions can cause one or more components of the polishing apparatus to execute the process. For example, the controller 190, or an in-situ monitoring system 160 including the controller 190, as shown in FIG. 1, can execute the process 1000. In some implementations, the in-situ monitoring system 160 can include an optical monitoring system, e.g., a spectrographic monitoring system. In other implementations, the in-situ monitoring system 160 can include an eddy current monitoring system.

As shown in FIG. 1, the in-situ monitoring system 160 includes a sensor 164, and circuitry 166 coupled to the sensor for sending and receiving signals between a controller 190, e.g., a computer. The sensor 164 can be, e.g., an end of an optical fiber to collect light for an optical monitoring system, or a core and coil of an eddy current monitoring system. The output of the circuitry 166 can be a digital electronic signal that passes through a rotary coupler 129, e.g., a slip ring, in the drive shaft 124 to the controller 190. Alternatively, the circuitry 166 could communicate with the controller 190 by a wireless signal.

The system first receives data representing a desired thickness profile for a substrate after polishing. The desired thickness profile can be specified by user request through a user input interface, or encoded in a computer program executed by the controller 190. The controller 190 can therefore determine a desired thickness of an edge region of a substrate according to the received data (1002).

The system determines a measured thickness of an edge region of the substrate (1004). More specifically, for each measurement, the controller 190 can calculate a characterizing value. The characterizing value is typically the thickness of the layer under polishing, but can be a related characteristic such as thickness removed. In addition, the characterizing value can be a physical property other than thickness, e.g., metal line resistance. In addition, the characterizing value can be a more generic representation of the progress of the substrate through the polishing process, e.g., an index value representing the time or number of platen rotations at which the spectrum would be expected to be observed in a polishing process that follows a predetermined progress. The system can then determine a discrepancy between the current polishing rate and desired polishing rate to reach the desire thickness profile in edge regions of a substrate after polishing.

In response, the system can make adjustments of the polishing rate periodically. In some implementations, the system schedules to adjust the polishing rates a predetermined rate, e.g., every given number of rotations, e.g., every 5 to 50 rotations, or every given number of seconds, e.g., every 2 to 20 seconds. In some ideal situations, the adjustment may be zero at the prescheduled adjustment time. In other implementations, the adjustments can be made at a rate determined in-situ. For example, if the measured thicknesses of edge regions are vastly different from the desired thickness profile, then the controller 190 and/or the computer may decide to make frequent adjustments for the polishing rates.

To adjust a polishing rate at an edge region of a substrate under polishing at a given adjustment rate, the controller 190 can apply a different combination of loads with different types and magnitudes after determining the combination.

Therefore, in response to determining the discrepancy, the system determines a combination of loads to apply on a loading area of the edge regions of the substrate (1006). More specifically, the system can determine a combination of load types (concentrated forces and distributed forces) or assembly modes (e.g., wide contact patch, narrow contact patch, center focused wide contact patch ,outer focused wide contact patch, or outer-center focused wide contact patch as described above) to adjust the polishing rate on respective edge regions of a substrate to achieve substantially in-wafer uniformity after polishing.

After determining the load magnitudes, load types, or assembly modes, the controller 190 controls either the valve assembly 189 or the pressure supply tanks 181, to change one or more pressure in one or more chambers to reach the determined loads or assembly mode (1008). Therefore, the system can precisely control polishing rates at respective portions of the edge regions when polishing a substrate.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Control of the various systems and processes described in this specification, or portions of them, can be implemented in a computer program product that includes instructions that are stored on one or more non-transitory computer-readable storage media, and that are executable on one or more processing devices. The systems described in this specification, or portions of them, can be implemented as an apparatus, method, or electronic system that may include one or more processing devices and memory to store executable instructions to perform the operations described in this specification.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Particular embodiments of the subject matter have been described. Other embodiments are within the scope of the following claims.

What is claimed is:

1. A carrier head for holding a substrate in a polishing system, comprising:

a housing;

an actuator comprising a pressurizable bladder;

an annular body that is vertically movable relative to the housing by the actuator, the annular body including an upper portion to engage the actuator and at least two lower posts projecting downward from the upper portion, wherein the pressurizable bladder is between the housing and the annular body, wherein the at least two lower posts includes a first lower post that projects downward from the upper portion by a distance that is greater than any remaining lower posts of the at least two lower posts;

a first annular membrane having a radially outermost edge that is secured to the annular body and a radially outermost vertical surface laterally separated from the housing by a gap, and the first annular membrane extending below the annular body to form at least two lower pressurizable chambers between the first annular membrane and the annular body, wherein the first annular membrane is configured to contact only an annular area extending radially inward from an edge of the substrate, with at least one lower post of the at least two lower posts located inside each of the at least two lower pressurizable chambers, and wherein the first lower post contacts a top surface of the first annular membrane before any remaining lower posts in response to a pressure increase in the pressurizable bladder when the substrate is held by the carrier head; and at least one pressure supply line connected to at least one lower pressurizable chamber of the at least two lower pressurizable chambers.

2. The carrier head of claim 1, wherein a bottom surface of the pressurizable bladder includes an annular recess and the annular body includes an upper annular post that extends into the annular recess.

3. The carrier head of claim 2, wherein the bottom surface of the pressurizable bladder is configured to apply a pressure downward on the annular upper post of the annular body.

4. The carrier head of claim 1, wherein a bottom surface of the first annular membrane is configured to apply a pressure to the substrate in a loading area, the loading area comprising a size controlled by a pressure in the pressurizable bladder and a pressure in at least one lower pressurizable chamber of the at least two lower pressurizable chambers.

5. The carrier head of claim 1, wherein the annular body includes a second annular membrane secured to the upper portion to define a first chamber, wherein at least one lower post of the at least two lower posts includes a first lower post secured to a bottom of the second annular membrane, and wherein the second annular membrane is configured to deform downward in response to the pressure increase in the first chamber to downwardly displace the first lower post to contact and apply a force on a top surface of the first annular membrane.

6. The carrier head of claim 5, wherein an upper post projects perpendicularly upward from a top surface of the second annular membrane into the pressurizable bladder.

7. The carrier head of claim 5, wherein the lower post secured to the bottom of the second annular membrane is not in contact with the top surface of the first annular membrane when the pressure in the first chamber increases.

8. The carrier head of claim 5, wherein the at least two lower posts includes a second lower post secured to an edge of the annular body.

9. The carrier head of claim 8, wherein the second lower post comprises an inwardly projecting flange.

10. The carrier head of claim 1, wherein each lower pressurizable chamber of the at least two lower pressurizable chambers is connected to a respective pressure supply through one of the at least one pressure supply line.

11. The carrier head of claim 1, wherein the at least two lower posts comprises a lower post with an inwardly projecting flange.

12. The carrier head of claim 1, wherein the at least two lower posts comprises a lower post that is secured to an edge of the annular body.

13. The carrier head of claim 12, wherein the at least one lower post comprises an inwardly projecting flange.

14. The carrier head of claim 1, wherein the at least two lower pressurizable chambers comprises three chambers, wherein the at least two lower posts includes at least three lower posts, wherein each of the three chambers encompasses at least one lower post of the at least three lower posts, wherein the at least one pressure supply line comprises a plurality of pressure supply lines and each of the three chambers is connected to a respective pressure supply through one of the plurality of pressure supply lines.

15. The carrier head of claim 1, comprising a plurality of pressure supplies, each pressure supply of the plurality of pressure supplies coupled to a respective pressure supply line of the at least one pressure supply line, and wherein each pressure supply can independently adjust a pressure in the at least two lower pressurizable chambers.

16. The carrier head of claim 1, wherein the first annular membrane is made of elastomer.

17. The carrier head of claim 1, wherein the annular body is made of plastic.

18. The carrier head of claim 1, wherein the annular area extends radially inward as a ring shape with a width of 4-6 mm starting from the edge of the substrate.

* * * * *